US011603990B2

(12) United States Patent
Wu

(10) Patent No.: US 11,603,990 B2
(45) Date of Patent: Mar. 14, 2023

(54) FUEL-BURNING DEVICE

(71) Applicant: Pro-Iroda Industries, Inc., Taichung (TW)

(72) Inventor: Wei Cheng Wu, Taichung (TW)

(73) Assignee: Pro-Iroda Industries, Inc., Taichung (TW)

( * ) Notice: Subject to any disclaimer, the term of this patent is extended or adjusted under 35 U.S.C. 154(b) by 308 days.

(21) Appl. No.: 16/940,523

(22) Filed: Jul. 28, 2020

(65) Prior Publication Data

US 2021/0048190 A1 Feb. 18, 2021

(30) Foreign Application Priority Data

Aug. 14, 2019 (TW) ..... 108128975

(51) Int. Cl.
*F23D 3/02* (2006.01)

(52) U.S. Cl.
CPC ..... *F23D 3/02* (2013.01); *F23D 2202/00* (2013.01)

(58) Field of Classification Search
CPC ..... F23D 3/02; F23D 3/24; F23D 2202/00
See application file for complete search history.

(56) References Cited

U.S. PATENT DOCUMENTS

2019/0101281 A1 4/2019 Chen

FOREIGN PATENT DOCUMENTS

DE 19508962 * 9/1996
GB 2080514 * 2/1982

* cited by examiner

*Primary Examiner* — Alfred Basichas
(74) *Attorney, Agent, or Firm* — Alan D. Kamrath; Karin L. Williams; Mayer & Williams PC

(57) ABSTRACT

A fuel-burning device includes a container defining a receptacle and having an opening which is at an end of the receptacle. The opening has a first width. The fuel-burning device also includes a fixing mechanism mounted in the container through a fixing member. The fixing member has an end resiliently fixed on a periphery of the receptacle. The fixing member is radially compressible. When the fixing member is not compressed, the end thereof has a second width which is greater than the first width. The end of the fixing member is compressible to a third width which is smaller than the first width.

16 Claims, 5 Drawing Sheets

FUEL-BURNING DEVICE

BACKGROUND OF THE INVENTION

1. Field of the Invention

The present invention relates to a fuel-burning device and, particularly, to a fixing mechanism of the fuel-burning device.

2. Description of the Related Art

TW Pat. No. I625493 discloses a fire-displaying device. The device includes an assembly of an accommodating device, a combustion device, and a fixing device. The accommodating device includes a fuel container, a top cover, and a heat insulator. The fuel container defines an accommodating portion and is covered by the top cover. The top cover defines a filler hole and a first positioning groove, which are in communication with the accommodating portion. The heat insulation member is supported by the top cover and defines a second positioning groove, which is in communication with the first positioning groove. The combustion device includes an end inserted into the accommodating portion through the second positioning groove and the first positioning groove. The fixing device includes a first clamping surface and a second clamping surface respectively clamping two side of the combustion device.

It is noted that there is no structure for fixing the combustion device and the fixing device in the accommodating device to prevent inadvertent shakes.

The present invention is, therefore, intended to obviate or at least alleviate the problems encountered in the prior art.

SUMMARY OF THE INVENTION

According to the present invention, a fuel-burning device includes a container defining a receptacle and having an opening which is at an end of the receptacle. The opening has a first width. The fuel-burning device also includes a fixing mechanism mounted in the container through a fixing member. The fixing member has an end resiliently fixed on a periphery of the receptacle. The fixing member defines a hollow portion into which a wick is adapted to insert. The hollow portion has a periphery including an expansion slit extending therethrough radially. The fixing member is radially compressible. When the fixing member is not compressed, the end thereof has a second width which is greater than the first width. The end of the fixing member is compressible to a third width which is smaller than the first width.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the public generally, and especially the scientists, engineers and practitioners in the art who are not familiar with patent or legal terms or phraseology, to determine quickly from a cursory inspection the nature and essence of the technical disclosure. The abstract is neither intended to define the invention, which is measured by the claims, nor is it intended to be limiting as to the scope of the invention in any way.

Other objectives, advantages, and new features of the present invention will become apparent from the following detailed description of the invention when considered in conjunction with the accompanied drawings.

DETAILED DESCRIPTION OF THE INVENTION

Figure 1:
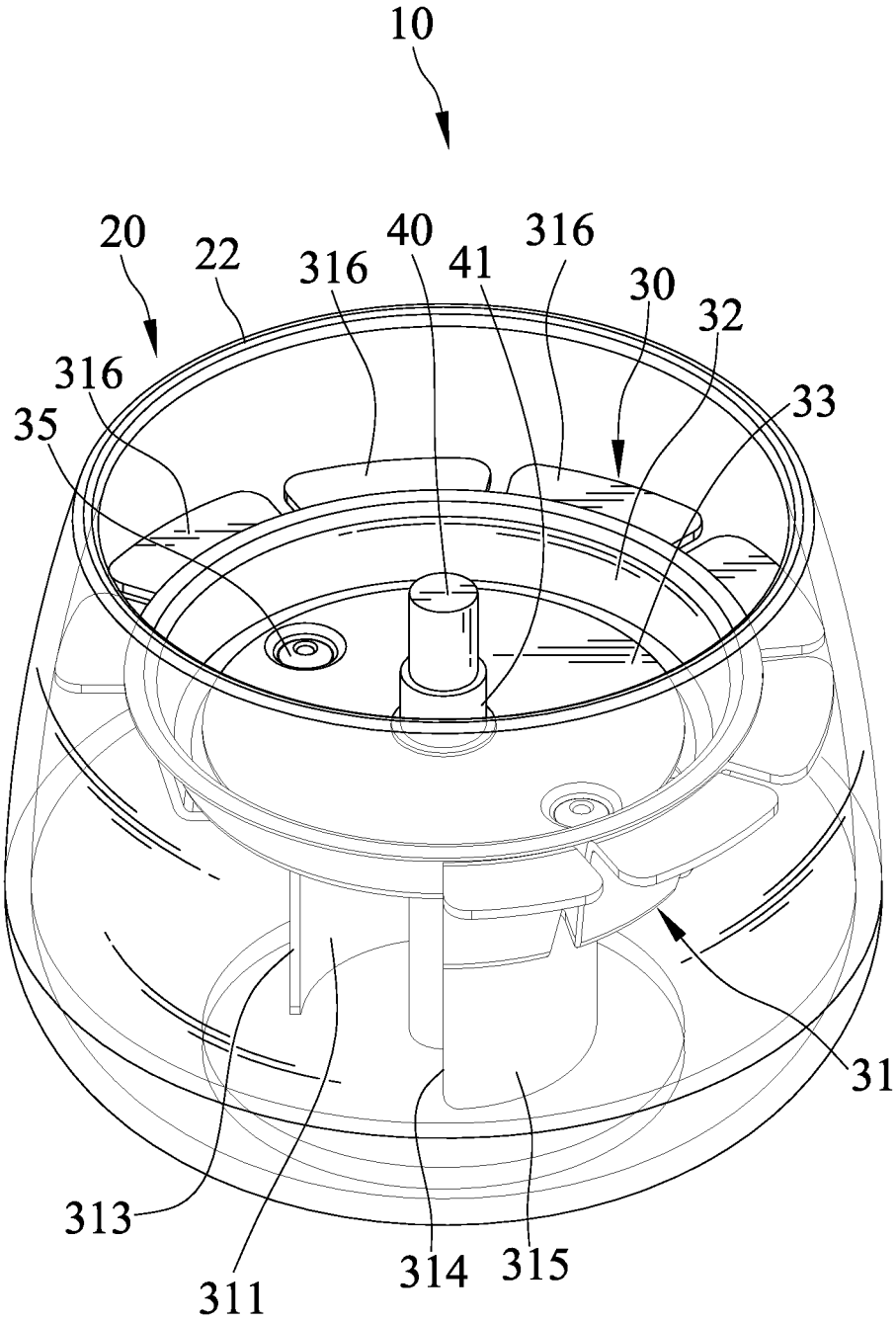
FIG. 1 is a perspective view of a fuel-burning device in accordance with the present invention.
Figure 2:
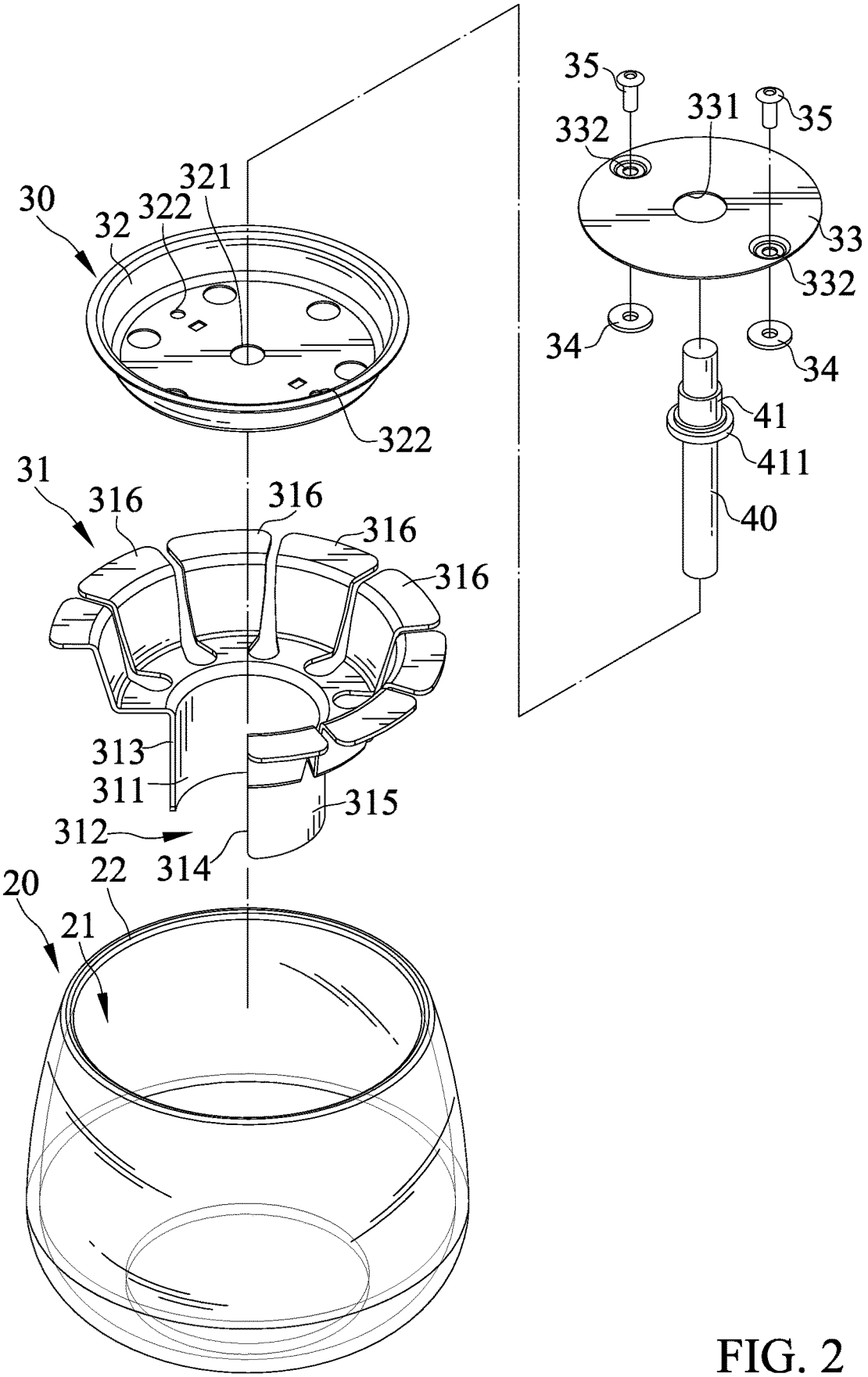
FIG. 2 is an exploded perspective view of FIG. 1.
Figure 3:
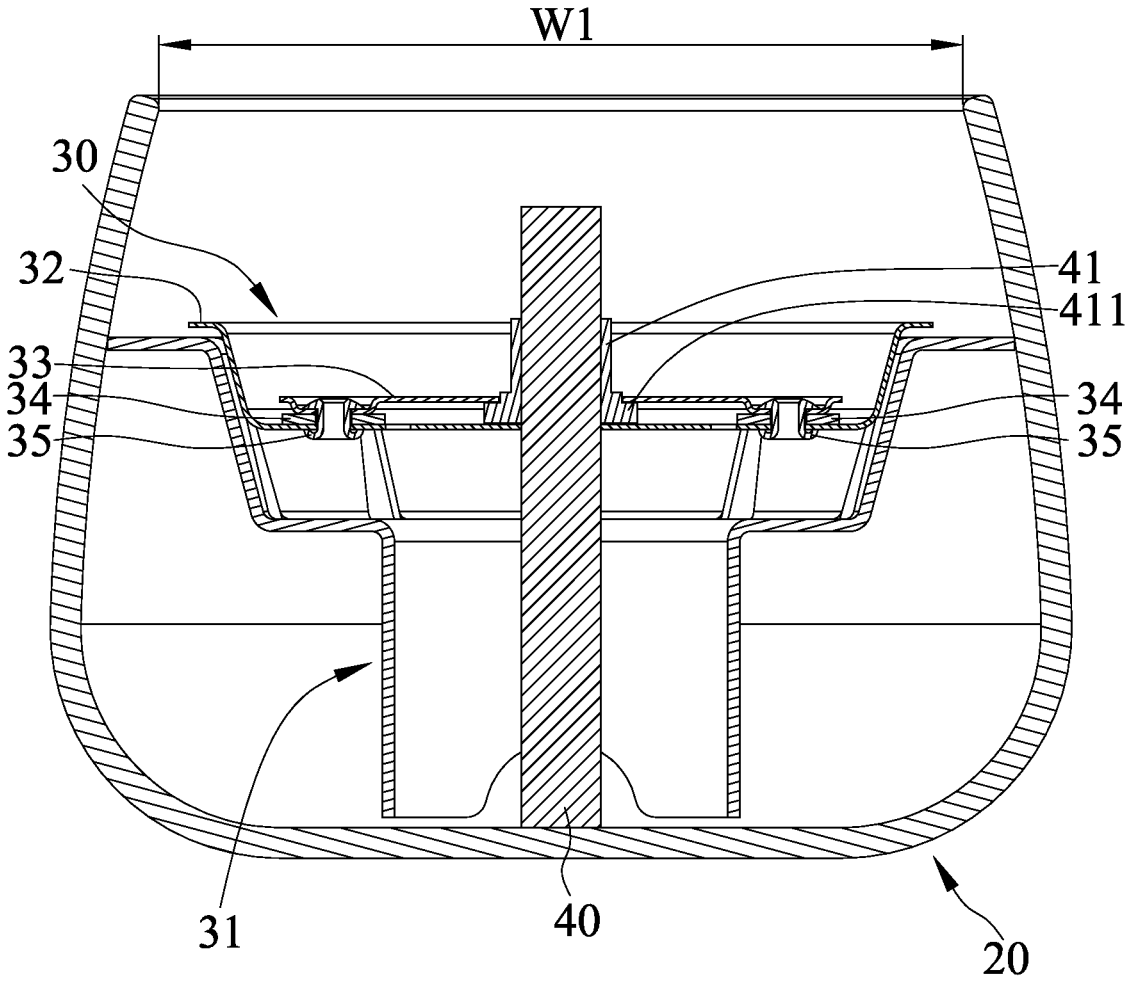
FIG. 3 is a cross-sectional view of FIG. 1.
Figure 4:
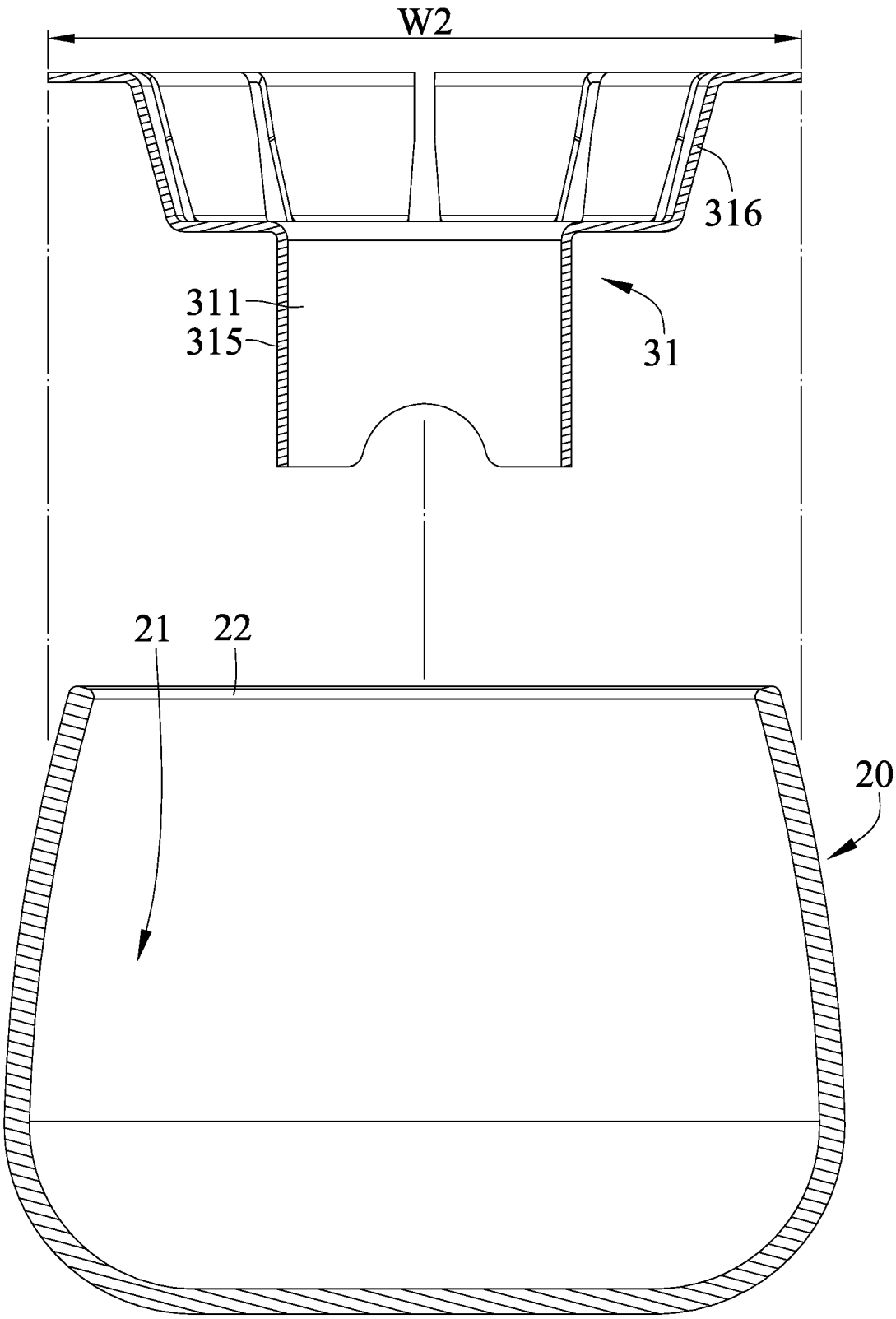
FIG. 4 is a cross-sectional view illustrating the fuel-burning device including a fixing mechanism disengaged therefrom.
Figure 5:
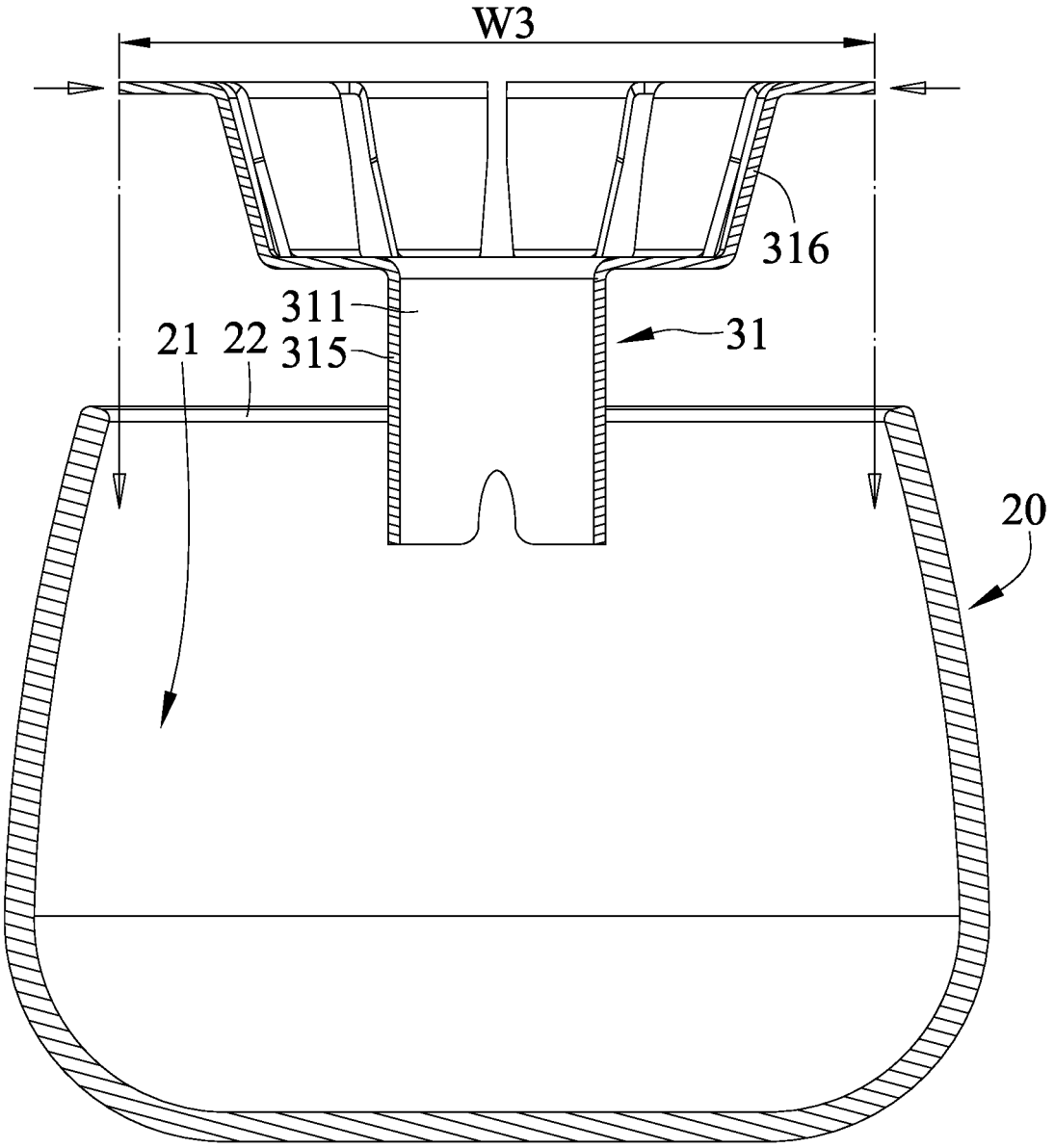
FIG. 5 is a cross-sectional view illustrating the fixing mechanism being compressible laterally.

FIGS. 1-5 show a fuel-burning device 10 in accordance with the present invention.

A container 20 defines a receptacle 21 and has an opening 22 which is at an end of the receptacle 21. The opening 22 in a width direction of the fuel-burning device 10 has a width W1. The container 20 is translucent. Thus, fire generated by the fuel-burning device 10 is viewable through the container 20.

A fixing mechanism 30 is mounted in the container 20 through a fixing member 31. The fixing member 31 has an end resiliently fixed on a periphery of the receptacle 21. The fixing member 31 is radially compressible. The fixing member 31 is made of rubber which is resilient. When the fixing member 31 is not compressed, the end thereof in the width direction of the fuel-burning device 10 has a width W2, i.e. the maximum width. The width W2 is greater than the width W1. The end of the fixing member 31 is compressible in the width direction of the fuel-burning device 10 to a width W3, i.e. the maximum width. The width W3 is smaller than the width W1. The method of mounting the fixing mechanism 30 in the container 20 includes compressing the fixing member 31 to decrease its width from the width W2 to the width W3 in order to insert through the opening 22 and then into the receptacle 21 and decompressing the fixing member 31 to increase its width to tightly abut against the receptacle 21.

Moreover, the fixing member 31 has a tubular portion 315 which defines a hollow portion 311 into which a wick 40 is adapted to insert. The tubular portion 315 is at another end of the fixing member 31. The hollow portion 311 has a periphery including an expansion slit 312 extending therethrough radially and so the tubular portion 315 has a non-closed periphery. The tubular portion 315 has ends 313 and 314 disposed separately and oppositely and the expansion slit 312 is bounded by the ends 313 and 314. The ends 313 and 314 include a decreasing distance therebetween in response to the compression of the fixing member 31. In addition, since the outer periphery of the fixing member 31 is partially defined by the outer periphery of the tubular portion 315, the expansion slit 312 makes the compression of the fixing member 31 easier.

Furthermore, as set forth above, the end of the fixing member 31 is resiliently fixed on a periphery of the receptacle 21. Particularly, the end of the fixing member 31 includes a plurality of handles 316 being resilient and abutting an inner periphery of the receptacle 21 tightly. The plurality of handles 316 extends radially. Each of the plurality of handles 316 has a fixed end connected to an outer periphery of the hollow portion 311 and a free end. The free end of one of the plurality of handles 316 and the free end of adjacent one of the plurality of handles 316 are spaced. The fixed end of one of the plurality of handles 316 and the fixed end of adjacent one of the plurality of handles 316 are spaced. Each of the plurality of handles 316 has a first length extending radially from the outer periphery of the hollow portion 311, a second length extending upwardly from the first length, and a third length extending radially from the second length.

A fuel tray 32 is born by the fixing member 31. The fuel tray 32 has a bottom and a raised rim. The bottom defines a through hole 321 into which the wick 40 is adapted to insert. The through hole 321 and the hollow portion 311 are open to each other. The end of the fixing member 31, i.e. the plurality of handles 316, defines an open recess and the fuel tray 32 is disposed in the open recess. The hollow portion 311 in the width direction of the fuel-burning device 10 has a smaller width than the open recess. The fuel tray 32 in the width direction of the fuel-burning device 10 has a greater width than the hollow portion 311.

A cap 33 is disposed at a height above the bottom of the fuel tray 32 such that the cap 33 and the bottom of the fuel tray 32 include a space separating them. The cap 33 defines a through hole 331 into which the wick 40 is adapted to insert. The through holes 321 and 331 are open to each other. The cap 33 is configured to protect fuel in the fuel tray 32 from dirt. The cap 33 and the fuel tray 32 include a fastening device secured therewith. The fastening device includes a fastener 35 and the fuel tray 32 and the cap 33 each define a hole 322 and 332 receiving the fastener 35. In addition, the fastening device includes at least one gasket 34 disposed between the bottom of the fuel tray 32 and the cap 33. The gasket 34 also defines a hole receiving the fastener 35.

A ring 41 in which the wick 40 is adapted to insert. The ring 41 is born by the bottom of the fuel tray 32. The cap 33 is supported by the ring 41. The ring 41 can prevent the cap 33 from falling. The ring 41 has a flange 411 which protrudes radially outwardly from the outer periphery of the ring 41. The flange 411 is stably fit in the through hole 331 of the cap 33 to enable the ring 41 and the fuel tray 32 to attach with each other stably.

In view of the foregoing, the fixing member 31 is adapted to fix to the receptacle 21 tightly and so the fuel tray 32, the wick 40, and the cap 33 are disposed stably.

The foregoing is merely illustrative of the principles of this invention and various modifications can be made by those skilled in the art without departing from the scope and spirit of the invention.

What is claimed is:

1. A fuel-burning device comprising:

a container defining a receptacle and having an opening which is at an end of the receptacle wherein the opening has a first width;

a fixing mechanism mounted in the container through a fixing member, wherein the fixing member has an end resiliently fixed on a periphery of the receptacle, wherein the fixing member defines a hollow portion into which a wick is adapted to insert, wherein the hollow portion has a periphery including an expansion slit extending therethrough radially, wherein the fixing member is radially compressible, wherein when the fixing member is not compressed, the end thereof has a second width which is greater than the first width, and wherein the end of the fixing member is compressible to a third width which is smaller than the first width; and a fuel tray born by the fixing member, wherein the fuel tray has a bottom and a raised rim and the bottom defines a through hole into which the wick is adapted to insert, and wherein the end of the fixing member defines an open recess and the fuel tray is disposed in the open recess.

2. The fuel-burning device as claimed in claim 1, wherein the fixing member has a tubular portion which defines the hollow portion, wherein the tubular portion has a first and second end disposed separately and oppositely and the expansion slit is bounded by the first and the second ends, and wherein the first and the second ends include a decreasing distance therebetween in response to the compression of the fixing member.

3. The fuel-burning device as claimed in claim 1, wherein when the fixing member is not compressed, the second width is the maximum width, and wherein when the fixing member is compressed, the third width is the maximum width.

4. The fuel-burning device as claimed in claim 1, wherein the hollow portion has a smaller width than the open recess.

5. The fuel-burning device as claimed in claim 4, wherein the fuel tray has a greater width than the hollow portion.

6. The fuel-burning device as claimed in claim 1 further comprising a cap disposed at a height above the bottom of the fuel tray such that the cap and the bottom of the fuel tray include a space separating them, and wherein the cap defines a through hole into which the wick is adapted to insert.

7. The fuel-burning device as claimed in claim 6 further comprising a ring in which the wick is adapted to insert, wherein the ring is born by the bottom of the fuel tray, and wherein the cap is supported by the ring.

8. The fuel-burning device as claimed in claim 7, wherein the cap and the fuel tray include a fastening device secured therewith, and wherein the fastening device includes a fastener and the fuel tray and the cap each define a hole receiving the fastener.

9. The fuel-burning device as claimed in claim 1, wherein the container is translucent.

10. A fuel-burning device comprising:

a container defining a receptacle and having an opening which is at an end of the receptacle wherein the opening has a first width;

a fixing mechanism mounted in the container through a fixing member, wherein the fixing member has an end resiliently fixed on a periphery of the receptacle, wherein the fixing member defines a hollow portion into which a wick is adapted to insert, wherein the hollow portion has a periphery including an expansion slit extending therethrough radially, wherein the fixing member is radially compressible, wherein when the fixing member is not compressed, the end thereof has a second width which is greater than the first width, wherein the end of the fixing member is compressible to a third width which is smaller than the first width, and wherein the end of the fixing member includes a plurality of handles being resilient and abutting an inner periphery of the receptacle tightly; and a fuel tray born by the fixing member, wherein the fuel tray has a bottom and a raised rim and the bottom defines a through hole into which the wick is adapted to insert, and wherein the plurality of handles defines an open recess and the fuel tray is disposed in the open recess.

11. The fuel-burning device as claimed in claim 10, wherein the fixed end of one of the plurality of handles and the fixed end of adjacent one of the plurality of handles are spaced.

12. The fuel-burning device as claimed in claim 10, wherein each of the plurality of handles has a first length extending radially from the outer periphery of the hollow portion, a second length extending upwardly from the first length, and a third length extending radially from the second length.

13. The fuel-burning device as claimed in claim 10, wherein the hollow portion has a smaller width than the open recess.

14. The fuel-burning device as claimed in claim 13, wherein the fuel tray has a greater width than the hollow portion.

15. A fuel-burning device comprising:

a container defining a receptacle and having an opening which is at an end of the receptacle wherein the opening has a first width;

a fixing mechanism mounted in the container through a fixing member, wherein the fixing member has an end resiliently fixed on a periphery of the receptacle, wherein the fixing member defines a hollow portion into which a wick is adapted to insert, wherein the hollow portion has a periphery including an expansion slit extending therethrough radially, wherein the fixing member is radially compressible, wherein when the fixing member is not compressed, the end thereof has a second width which is greater than the first width, wherein the end of the fixing member is compressible to a third width which is smaller than the first width, and wherein the end of the fixing member includes a plurality of handles being resilient and abutting an inner periphery of the receptacle tightly, wherein the plurality of handles extends radially, wherein each of the plurality of handles has a fixed end connected to an outer periphery of the hollow portion and a free end, and wherein the free end of one of the plurality of handles and the free end of adjacent one of the plurality of handles are spaced; and a fuel tray born by the fixing member, wherein the fuel tray has a bottom and a raised rim and the bottom defines a through hole into which the wick is adapted to insert, and wherein the plurality of handles defines an open recess and the fuel tray is disposed in the open recess.

16. The fuel-burning device as claimed in claim 15, wherein each of the plurality of handles has a first length extending radially from the outer periphery of the hollow portion, a second length extending upwardly from the first length, and a third length extending radially from the second length.

* * * * *